US010669134B2

(12) United States Patent
Shaughnessy

(10) Patent No.: US 10,669,134 B2
(45) Date of Patent: Jun. 2, 2020

(54) TRUCK SUSPENSION USED AS A CRANE COUNTERWEIGHT

(71) Applicant: John Shaughnessy, Pembroke, MA (US)

(72) Inventor: John Shaughnessy, Pembroke, MA (US)

( * ) Notice: Subject to any disclaimer, the term of this patent is extended or adjusted under 35 U.S.C. 154(b) by 0 days.

(21) Appl. No.: 15/649,102

(22) Filed: Jul. 13, 2017

(65) Prior Publication Data

US 2018/0016121 A1 Jan. 18, 2018

Related U.S. Application Data

(60) Provisional application No. 62/362,786, filed on Jul. 15, 2016.

(51) Int. Cl.

| | |
|---|---|
| ***B66C 23/76*** | (2006.01) |
| ***B66C 23/36*** | (2006.01) |
| *B66C 23/80* | (2006.01) |

(52) U.S. Cl.

CPC ..... *B66C 23/76* (2013.01); *B66C 23/36* (2013.01); *B66C 23/80* (2013.01); *B66C 2700/0392* (2013.01)

(58) Field of Classification Search

CPC ..... B66C 23/36; B66C 23/72; B66C 23/74; B66C 23/76; B66C 23/80; B66C 2700/0392

See application file for complete search history.

(56) References Cited

U.S. PATENT DOCUMENTS

| | | | | | |
|---|---|---|---|---|---|
| 3,842,984 | A * | 10/1974 | Brown | B60G 3/00 | 212/195 |
| 4,540,097 | A * | 9/1985 | Wadsworth | B66C 23/74 | 212/178 |
| 4,711,358 | A * | 12/1987 | Konishi | B66C 23/82 | 212/178 |
| 4,995,518 | A * | 2/1991 | McGhie | B66C 23/74 | 212/178 |
| 5,222,613 | A * | 6/1993 | McGhie | B66C 23/36 | 212/178 |
| 5,586,667 | A * | 12/1996 | Landry | B66C 23/76 | 212/195 |
| 6,065,620 | A * | 5/2000 | McGhie | B66C 23/74 | 212/178 |

* cited by examiner

*Primary Examiner* — Sang K Kim
*Assistant Examiner* — Nathaniel L Adams
(74) *Attorney, Agent, or Firm* — Duquette Law Group, LLC

(57) ABSTRACT

A boom truck includes a truck chassis having a frame, a boom assembly connected to the frame, and a boom counter weight assembly rotatably connected to the boom assembly. The boom counter weight assembly is configured to be disposed between a first position to extend a wheel base of the boom truck and a second position to define a counter-weight relative to the boom assembly.

5 Claims, 4 Drawing Sheets

TRUCK SUSPENSION USED AS A CRANE COUNTERWEIGHT

RELATED APPLICATIONS

This patent application claims the benefit of U.S. Provisional Application No. 62/362,786 filed on Jul. 15, 2016, entitled, "Truck Suspension Used As A Crane Counterweight," the contents and teachings of which are hereby incorporated by reference in their entirety.

BACKGROUND

Conventional boom trucks typically include a telescoping or extendable arm mounted to the truck frame. For example, front mounted boom trucks typically include a boom assembly mounted to the truck frame at a location near the cab of the boom truck. In another example, rear mounted boom trucks typically include a boom assembly mounted to the to the truck frame at a location near the rear axle of the truck. In either case, these boom trucks typically do not include a counterweight and instead rely on the weight of the vehicle to counterbalance a load carried by the boom during operation.

SUMMARY

The U.S. Federal Bridge Formula was established to limit the weight-to-length ratio of vehicles in order to minimize the wear-and-tear experienced by bridges in the U.S. highway system. Under present regulations, two or more consecutive axles of a vehicle may not exceed the weight computed by the Bridge Formula even though single axles, tandem axles, and gross vehicle weights are within legal limits. For example, for a vehicle having a gross vehicle weight of 80,000 pounds, the Federal Bridge Formula requires a minimum distance of thirty-four feet, six inches between a centerline of a front tandem and a centerline of a rear tandem.

Conventional boom trucks typically do not meet the requirements of the U.S. Federal Bridge Formula. For example, conventional boom trucks in the weight range of 48,000 to 58,000 pounds typically have a consecutive axle wheel base of twenty-six feet, on average. Further, conventional boom trucks in the weight range of between about 48,000 and 84,000 pounds typically have a consecutive axle wheel base of thirty-one feet, on average. In these examples, a permit is required to drive the boom trucks on the road ways in the U.S.

Further, the permits are typically only issued for boom trucks having an irreducible load. Under these requirements, in order to be compliant with the permit, the boom truck operator cannot add a counterweight to the boom in order to counterbalance the boom during operation. This limits the amount of load that the boom can lift during operation.

By contrast to conventional boom trucks, embodiments of the present innovation relate to a boom truck having a boom counterweight assembly. In one arrangement, the boom counter weight assembly includes a frame connected to a wheel base assembly where the wheel base assembly includes a set of wheels connected to a base by an axle. The boom counter weight assembly increases weight-to-length ratio of a corresponding boom truck when driven. For conventional boom trucks in the weight range of between about 48,000 and 84,000, this allows the boom trucks to be compliant with U.S. Federal Bridge Formula and limits need for special permits. Also, the boom counterweight assembly can operate as a counterweight to the boom during operation. Because the boom counterweight assembly merely pivots relative to the boom and is not added or removed before and after operation, the boom counterweight assembly maintains the requirements of the boom truck having an irreducible load.

In one arrangement, a boom truck, comprises a truck chassis having a frame, a boom assembly connected to the frame, and a boom counter weight assembly rotatably connected to the boom assembly. The boom counter weight assembly is configured to be disposed between a first position to extend a wheel base of the boom truck and a second position to define a counterweight relative to the boom assembly.

BRIEF DESCRIPTION OF THE DRAWINGS

The foregoing and other objects, features and advantages will be apparent from the following description of particular embodiments of the innovation, as illustrated in the accompanying drawings in which like reference characters refer to the same parts throughout the different views. The drawings are not necessarily to scale, emphasis instead being placed upon illustrating the principles of various embodiments of the innovation.

DETAILED DESCRIPTION

Embodiments of the present innovation relate to a boom truck having a boom counterweight assembly. In one arrangement, the boom counter weight assembly includes a frame connected to a wheel base assembly where the wheel base assembly includes a set of wheels connected to a base by an axle. The boom counter weight assembly increases weight-to-length ratio of a corresponding boom truck when driven. For conventional boom trucks in the weight range of between about 48,000 and 84,000, this allows the boom trucks to be compliant with U.S. Federal Bridge Formula and limits need for special permits. Also, the boom counterweight assembly can operate as a counterweight to the boom during operation. Because the boom counterweight assembly merely pivots relative to the boom and is not added or removed before and after operation, the boom counterweight assembly maintains the requirements of the boom truck having an irreducible load.

Figure 1:
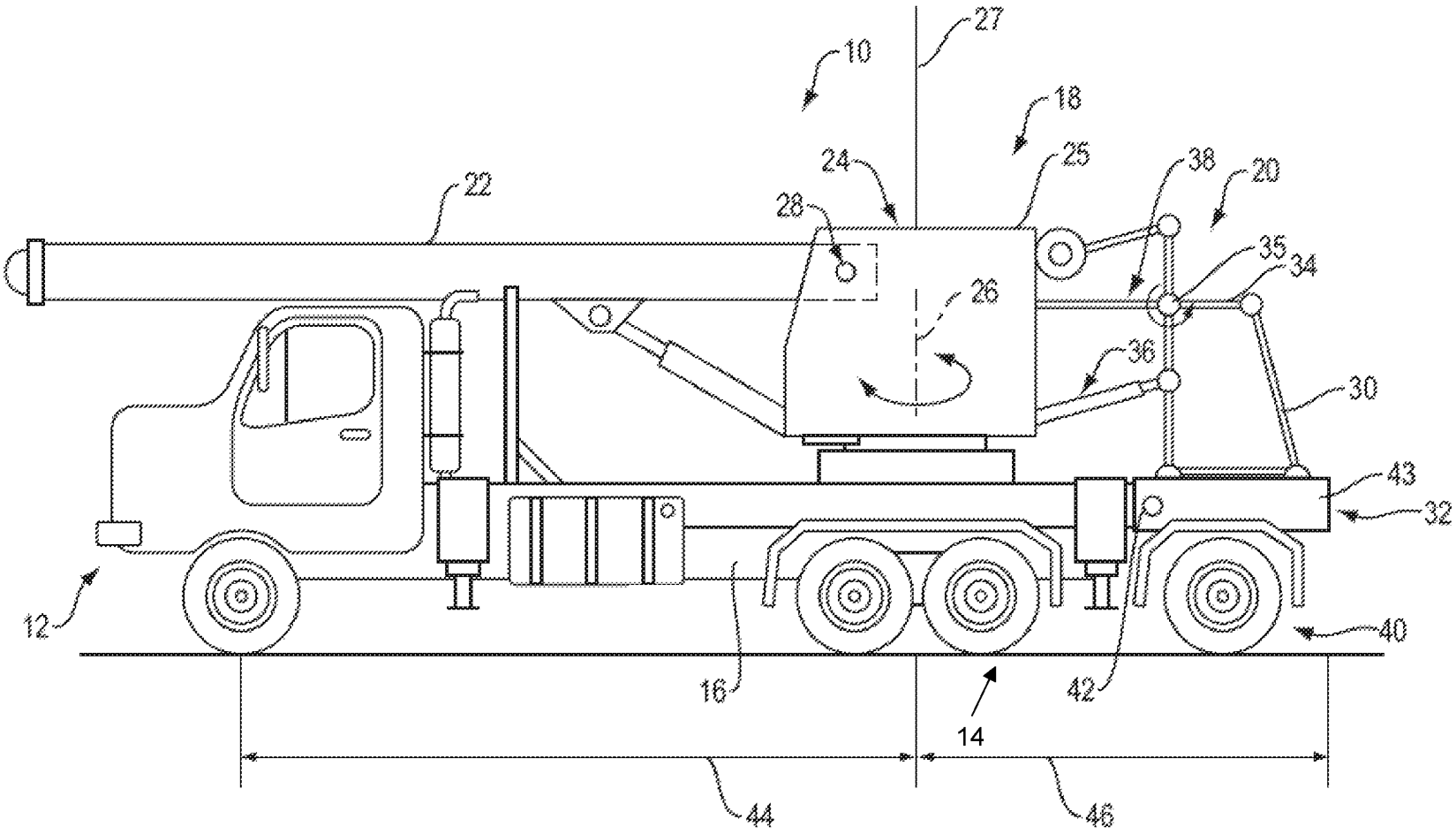
FIG. 1 illustrates a schematic side view of a boom truck having a boom counterweight assembly, according to one arrangement.

FIG. 1 illustrates a boom truck 10, according to one arrangement. As illustrated, the boom truck 10 includes a truck chassis 12 which includes a frame 16, a boom assembly 18 mounted to the frame 16 and a capacity enhancing device, termed a boom counter weight assembly 20. In one arrangement, the frame 16 can be manufactured from 80,000 P.S.I. steel, 110,000 P.S.I. steel, or, in certain cases, 130,000 P.S.I. steel. In one arrangement, the boom truck 10 includes an air ride suspension on the two rear drive axles.

The boom assembly 18 includes a boom 22 and a boom control 24 rotatably coupled to the frame 16. The boom control 24 is configured to allow a user to operate the boom 22. For example, the boom control 24 includes a housing 25 containing a set of controls (not shown) that allow the operator to rotate the boom control 24 about a longitudinal axis 26 relative to the frame 16 and to rotate the boom 22 about a lateral axis 28 relative to the housing 25.

In the example illustrated, the boom counter weight assembly 20 includes a frame 30 connected to a wheel base assembly 32. While the frame 30 can be configured in a variety of ways, in one arrangement, the frame 30 includes a set of metallic bars, such as steel bars, that defines a substantially hollow structure.

Figure 2:
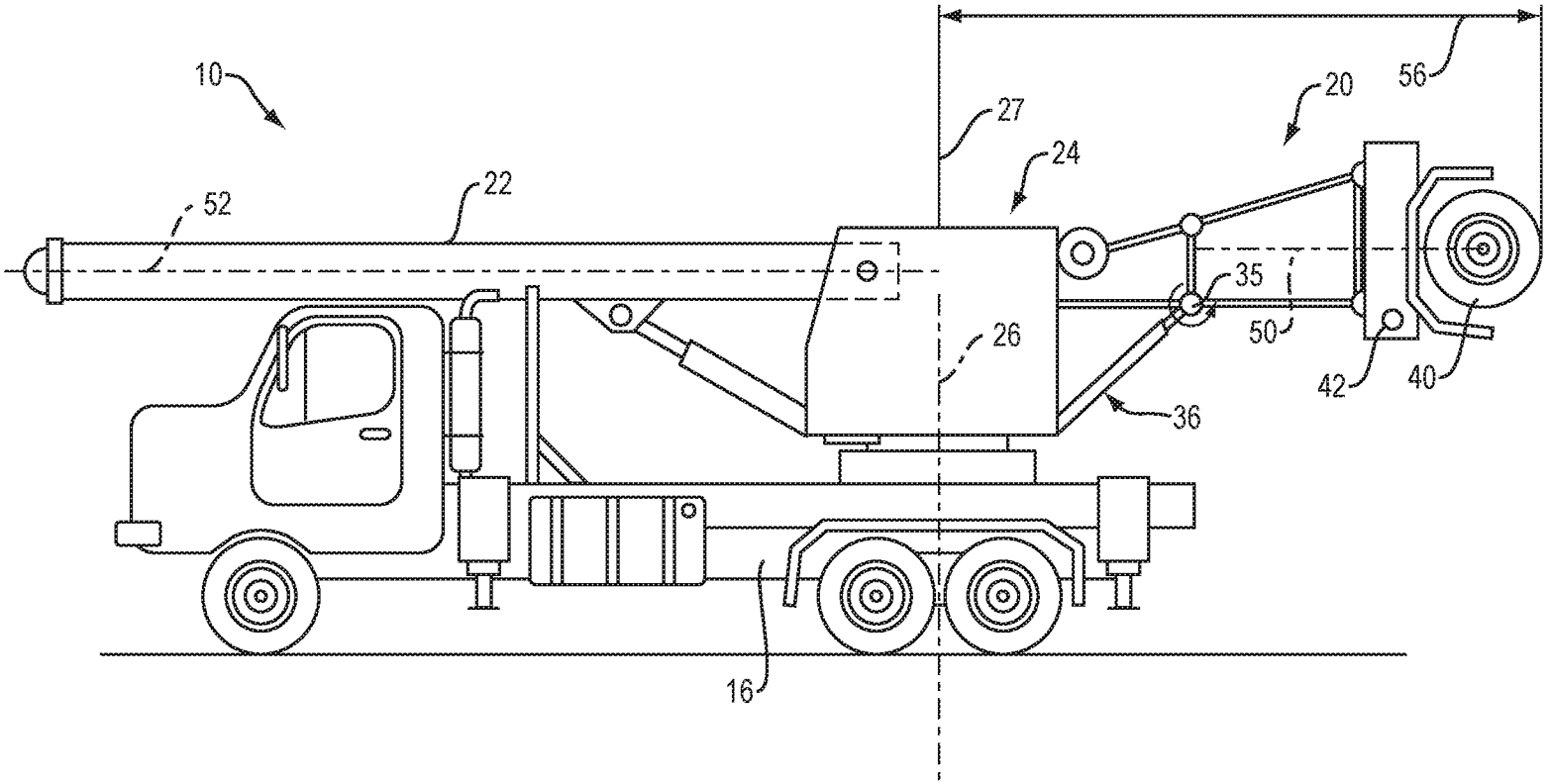
FIG. 2 illustrates the schematic side view of a boom truck of FIG. 1 having the boom counterweight assembly disposed in a full tail swing mode, according to one arrangement.
Figure 3:
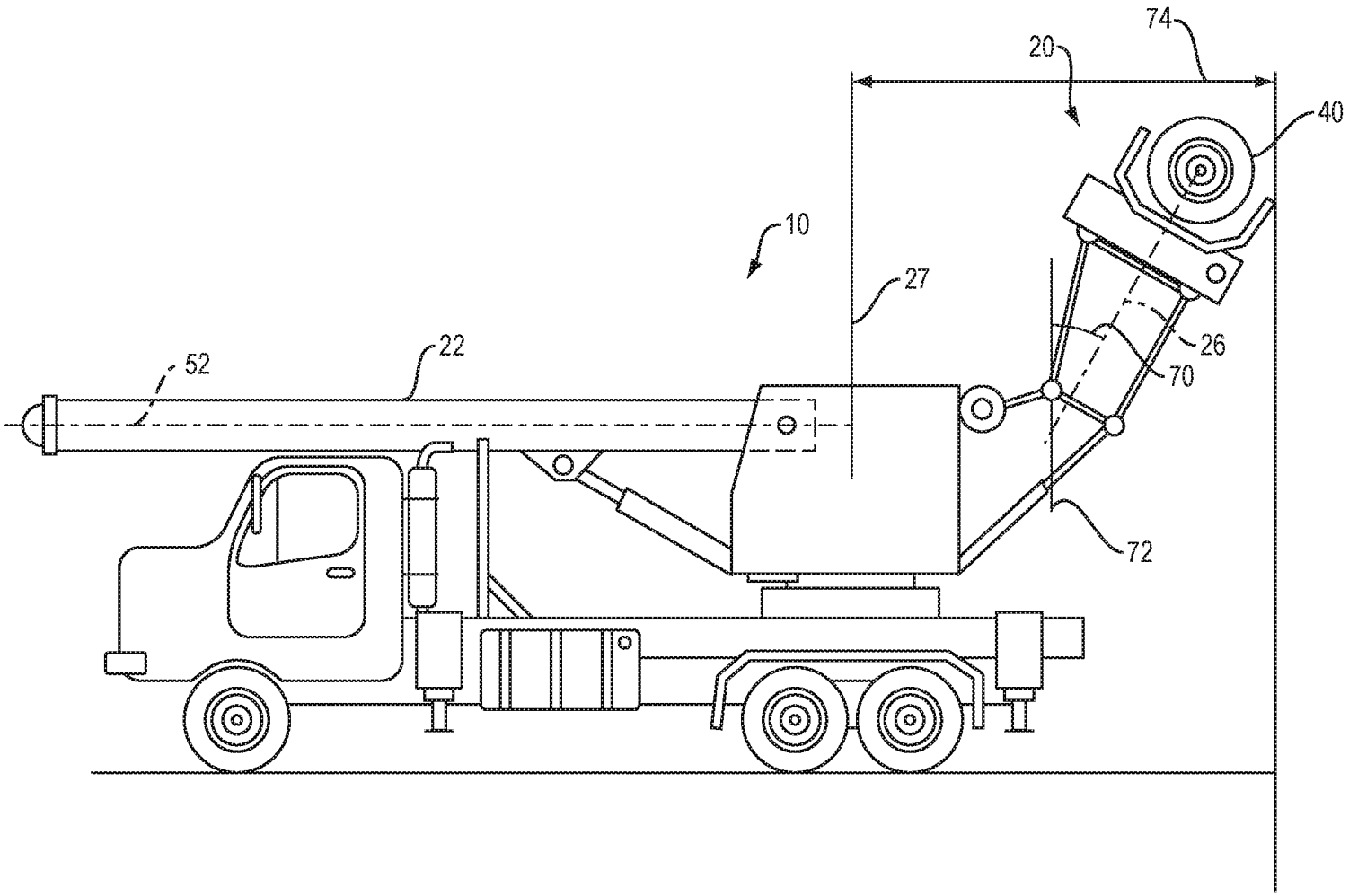
FIG. 3 illustrates a schematic side view of the boom truck of FIG. 1 having the boom counterweight assembly disposed in a zero tail swing mode, according to one arrangement.
Figure 4:
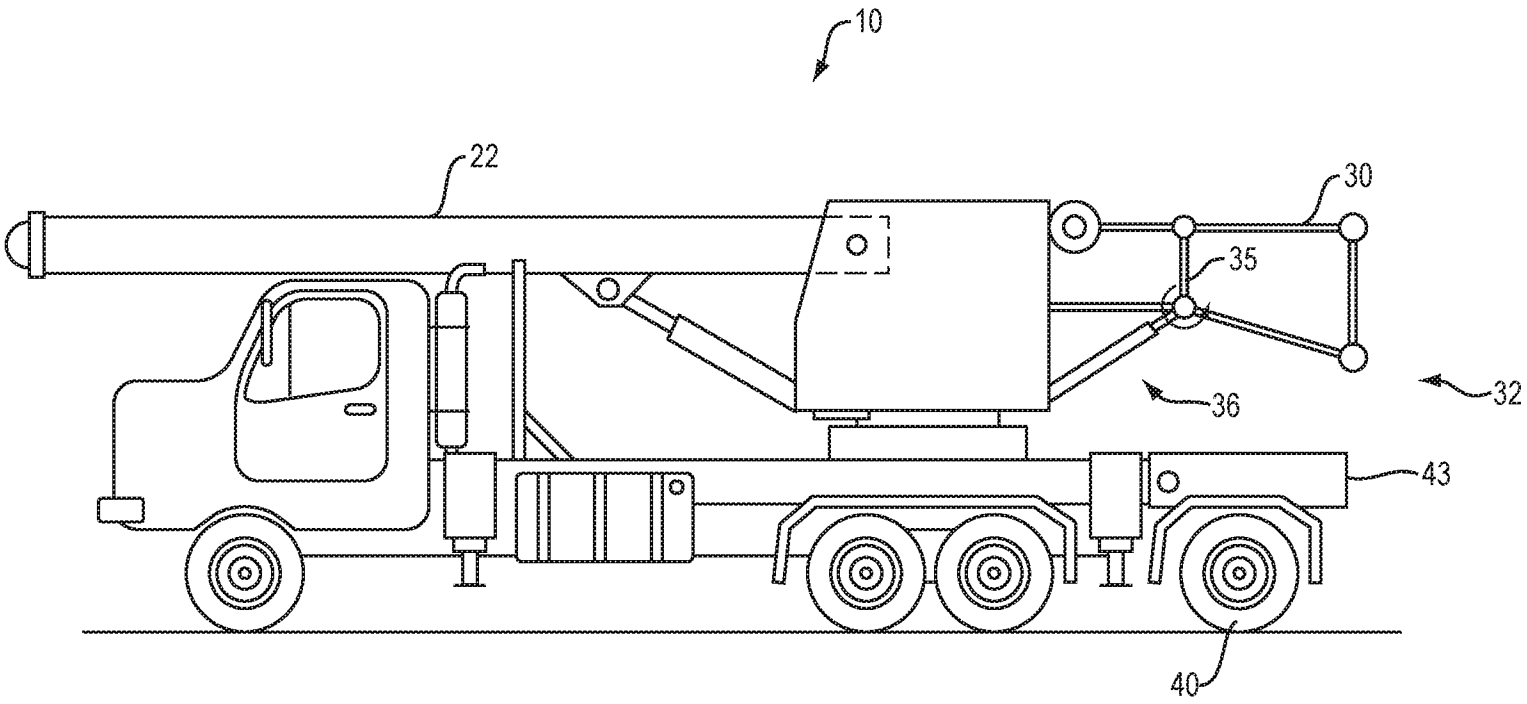
FIG. 4 illustrates a schematic side view of a boom truck having a boom counterweight assembly, according to one arrangement.

The frame 30 is rotatably connected to the housing 25, via a connection 35, such as a pin connection. In one arrangement, the boom assembly 18 includes a hydraulic cylinder assembly 36 connected between the frame 16 and the frame 30 of the boom counter weight assembly 20. As will be described below, the hydraulic cylinder assembly 36 is configured to rotate the boom counter weight assembly 20 between a first position, as shown in FIG. 1, and a second, counterweight position, as shown in FIGS. 2-4. The location of the connection of the hydraulic cylinder assembly 36 relative to the frame 30 can vary depending on the load capacity of the hydraulic cylinder assembly 36.

In one arrangement, a hydraulic cylinder of the hydraulic cylinder assembly 36 includes a holding valve configured to hold pressure in case of a hydraulic hose failure. In one arrangement, the hydraulic cylinder assembly 36 includes a travel limiting device to limit the rotation of the boom counter weight assembly 20 to the second position to limit damage when lifted into a crane operating position. In one arrangement, the frame that the hydraulic cylinder is attached to is configured with adequate capacity to safely lift the flip axle from a travel to crane operating position.

In the arrangement shown, the wheel base assembly 32 includes a set of wheels 40 connected to a base 43 by an axle (not shown). The base 43 is connected to the frame 16 via a removable pin connection. In one arrangement, the wheel base assembly 32 is configured as a flip axle. In one arrangement, the flip axle is manufactured from the same strength steel as the frame 16 (e.g., 80,000 P.S.I. steel, 110,000 P.S.I. steel, or, 130,000 P.S.I. steel). With a flip axle configuration, the wheel base assembly 32 includes a braking mechanism for the wheels but is not powered by a drive shaft of the boom truck 10. In one arrangement, the brakes of the flip axle can receive air for operation via an airline 38.

In one arrangement, a frame of the flip axle can run parallel with the truck frame 16 and two or three cross members (i.e., depending on crane capacity) can be installed on the frame of the flip axle at a 90° angle relative to the truck frame 16. Depending on the truck manufacturer, the cross members can be assembled with HUCKBOLTS™, similar to those used in a cross member above the truck's transmission, to minimize loosening during use. In one arrangement, the flip axle includes an air ride suspension, as opposed to a leaf spring suspension, as well as both an automatic and manual air pressure limiting control. In one arrangement, the flip axle can be disposed in a variety of operating positions, such as between 3 and 5 operating positions. Each position can include have a proximity switch which is coordinated by the truck's lifting computer or L.M.I. In one arrangement, the weight of the frame and flip axle will vary, according to the lifting capacity of the crane.

During operation, the boom counter weight assembly 20 is configured to rotate between a first position, as illustrated in FIG. 1, to a second position, as illustrated in FIGS. 2 and 3, relative to the boom control 24 to act as a counterweight to the boom assembly 18.

In the first position as illustrated in FIG. 1, the wheel base assembly 32 of the boom counter weight assembly 20 is connected to the frame 16, via a connection 42 such as a pin. When disposed in the first position, the boom truck 10 can be driven from location to location without requiring a travel permit. For example, the length 44 of the wheel base of the truck chassis 12 is about 26 feet while the length 46 of the wheel base between a tag axle 14 and the wheel base assembly 32 is between about 10 feet and 15 feet, depending upon capacity. In total, the boom truck 10 is configured with a wheel base of between about 36 feet and 51 feet.

As provided above, the boom counter weight assembly 20 is configured to rotate relative to the boom control 24 to act as a counterweight to the boom assembly 18. In one arrangement, in a second position as illustrated in FIG. 1, the boom counter weight assembly 20 is disposed relative to the boom 22 such that a longitudinal axis 50 of the boom counter weight assembly 20 is substantially aligned with a longitudinal axis 52 of the boom 22. For example, in the second position the length 56 of the moment arm formed by the boom counter weight assembly 20 from a vertical axis 27 of the boom control 24 to an outer portion of the wheel 40 is between about 10 feet and 15 feet. Such positioning is termed full tail swing mode. For a boom truck 10 having a capacity between about 30,000 pounds and 120,000 pounds (between about 15 and 60 tons) a tag axle weight of the boom truck 10 (i.e., the weight of the non-powered rearmost axle as disposed behind the drive axles) is between about 7,000 pounds and 16,000 pounds.

During operation, for example, the operator disengages the boom counter weight assembly 20 from the frame 16 via connector 42. The operator actuates the hydraulic cylinder assembly 36 to rotate the boom counter weight assembly 20 about connection 35. With the boom counter weight assembly 20 positioned in full tail swing mode (i.e., such that the longitudinal axis 50 of the boom counter weight assembly 20 is substantially aligned with the longitudinal axis 52 of the boom 22), the boom counter weight assembly 20 is configured as a counterweight to the boom 22 during operation. The counterweight allows the boom operator to extend the boom 22 at a distance from the boom control 24 and increases amount of load that the boom 22 can lift during operation, compared to conventional boom trucks.

Use of the boom counter weight assembly 20 allows the use of a counterweight with the boom truck 10. Additionally, the boom counter weight assembly 20 provides a number of benefits to the boom truck 10. For example, as provided above, when disposed in the first position, the boom counter weight assembly 20 extends the length of the wheel base of the boom truck 10. Therefore, in the case where the boom truck 10 has a weight of between about 48,000 pounds and 84,000 pounds, the total length of the wheel base for the boom truck 10 (i.e., a length between about between about 36 feet and 46 feet). Accordingly, a boom truck 10 having a boom counter weight assembly 20 meets the U.S. Federal Bridge Formula without requiring a particular travel permit.

In another example, because the boom counter weight assembly 20 is connected to the boom control 24 in a substantially secure manner, the boom truck 10 meets the requirements of having an irreducible load. In the event that the boom truck 10 required a permit under the U.S. Federal Bridge Formula, because the boom truck 10 includes an irreducible load, the boom truck 10 can be considered compliant with the permit.

As provided above, the boom counter weight assembly 20 can be positioned in full tail swing mode, shown in FIG. 2. However, the boom counter weight assembly 20 can be disposed in a variety of positions relative to the boom control 24.

For example, as illustrated in FIG. 3, the boom counter weight assembly 20 can be disposed such that the longitudinal axis 26 of the boom counter weight assembly 20 defines an acute angle 70 relative to a vertical reference 72 where the vertical reference 72 is substantially parallel to the vertical axis 27 of the boom control 24. With such positioning, termed zero tail swing mode, a distance 74 between the vertical axis 27 and the outer edge of the wheels 40 is less than the distance 56 illustrated in FIG. 2. Therefore, in this position, the boom counter weight assembly 20 can act as a counter weight with a relatively reduced moment arm within a relatively narrow space. As such, the boom counter weight assembly 20 can be utilized in cases where space is an issue.

As described above, during operation, an operator disengages the boom counter weight assembly 20 from the frame 16 via connector 42 and actuates the hydraulic cylinder assembly 36 to rotate the boom counter weight assembly 20 (i.e., the frame 30 and wheel base assembly 32) about connection 35. Such description is by way of example only. In one arrangement, with reference to FIG. 4, the frame 30 is configured to be disengaged from the base 43 and rotated about connection 35 via the hydraulic cylinder assembly 36.

As provided above, certain dimensions were used for different aspects of the boom truck. For example, as described with reference to FIG. 2, in the second position the length 56 of the moment arm formed by the boom counter weight assembly 20 from a vertical axis 27 of the boom control 24 to an outer portion of the wheel 40 is between about 10 feet and 15 feet. Further, with reference to FIG. 3, in zero tail swing mode, a distance 74 between the vertical axis 27 and the outer edge of the wheels 40 is less than the distance 56 illustrated in FIG. 2. These, and other, dimensions described above are provided by way of example only. It is understood that all dimensions are variable and approximate, according to different capacities associated with the particular boom truck.

While various embodiments of the innovation have been particularly shown and described, it will be understood by those skilled in the art that various changes in form and details may be made therein without departing from the spirit and scope of the innovation as defined by the appended claims.

What is claimed is:

1. A boom truck, comprising:

a truck chassis having a frame and set of wheels disposed on consecutive axels coupled to the frame;

a boom assembly having a boom and a boom control rotatably connected to the frame; and a boom counter weight assembly having an assembly frame rotatably connected to the boom assembly and a wheel base assembly coupled to the assembly frame, the wheel base assembly having a set of wheels disposed on a base by an axle;

wherein the boom counter weight assembly is configured to rotate between a first position such that a longitudinal axis of the base is substantially parallel to a longitudinal axis of the frame and the wheel base assembly extends a wheel base of the boom truck and a second position such that the longitudinal axis of the base is non-parallel to the longitudinal axis of the frame and the set of wheels of the wheel base assembly is disposed at a distance from a ground surface of the boom truck to define a counterweight relative to the boom assembly.

2. The boom truck of claim 1, wherein, when the boom counter weight assembly is disposed in the second position, the boom counter weight assembly forms a moment arm between a vertical axis of the boom control and an outer portion of the set of wheels of the wheel base assembly to define the counterweight relative to the boom assembly.

3. The boom truck of claim 2, wherein, when the boom counter weight assembly is disposed in a full tail swing mode as the second position, a longitudinal axis of the boom counter weight assembly is substantially perpendicular to a vertical axis of the boom control.

4. The boom truck of claim 2, wherein, when the boom counter weight assembly is disposed in a zero tail swing mode as the second position, a longitudinal axis of the boom counter weight assembly defines an acute angle relative to a vertical axis of the boom control.

5. The boom truck of claim 1, wherein the boom counter weight assembly further comprises a hydraulic cylinder assembly configured to rotate the boom counter weight assembly relative to the boom assembly.

* * * * *